United States Patent [19]

Baclit

[11] 4,210,972

[45] Jul. 8, 1980

[54] DETACHABLE VISOR ARRANGEMENT

[76] Inventor: Paul S. Baclit, 2167 College View Dr., Monterey Park, Calif. 91754

[21] Appl. No.: 32,782

[22] Filed: Apr. 24, 1979

[51] Int. Cl.[2] ..... A42B 1/24

[52] U.S. Cl. ..... 2/10

[58] Field of Search ..... 2/10, 8, 9, 424, 5, 2/6

[56] References Cited

U.S. PATENT DOCUMENTS

| | | | |
|---|---|---|---|
| 1,182,367 | 5/1916 | Gravell | 2/8 |
| 2,421,427 | 6/1947 | Mamlin et al. | 2/10 X |
| 2,718,006 | 9/1955 | Bowers, Sr. | 2/8 X |
| 2,834,017 | 5/1958 | Simpson et al. | 2/10 X |
| 3,720,956 | 3/1973 | Raschke | 2/8 |

FOREIGN PATENT DOCUMENTS

| | | | |
|---|---|---|---|
| 2030546 | 12/1971 | Fed. Rep. of Germany | 2/10 |
| 704714 | 2/1952 | United Kingdom | 2/8 |

*Primary Examiner*—Peter P. Nerbun
*Attorney, Agent, or Firm*—Don B. Finkelstein

[57] ABSTRACT

A detachable visor for a cap that is detachably mountable on the bill of the cap. The visor has a face shield pivotally interconnected by hinge means to a pair of spaced apart clip means. The clip means detachably mount on the bill of the cap. In the first mounting condition, a face shield depends downwardly from the bill of the cap to guard the face of the wearer of the cap and is pivotally movable on the hinge means to a clear position where the face shield extends upwardly from the upper surface of the bill of the cap. The visor is also mountable in a second mounting condition wherein the face shield extends upwardly from the bill of the cap in a different orientation than in the clear position. Restraining means may be provided for restraining the face shield with respect to the cap in any of the desired positions thereof.

12 Claims, 5 Drawing Figures

DETACHABLE VISOR ARRANGEMENT

BACKGROUND OF THE INVENTION

1. Field of the Invention

This invention relates to a novel face shield arrangement, primarily adapted to protect the face of the wearer of the cap from wind, dust, or other fine particles or the like, and, more particularly, to such structure that is detachably mountable on the bill of a cap and movable into a plurality of positions with respect thereto.

2. Description of the Prior Art

Hat arrangements of various and sundry types, incorporating visors providing a face shield to protect the face of the wearer of the hat are well known and have been utilized in many applications in the past. These applications, however, have generally comprised those applications involved in industrial operations, construction operations or the like, such as welder's masks, safety helmets, and similar situations. Examples of such hats incorporating face masks are shown in U.S. Pat. Nos. 3,035,270; 3,346,876; 3,555,562; 3,594,816; 3,668,706; 3,685,054 and 3,336,598.

However, in many other applications not involving industrial or occupational hazards, a face mask is often desired for utilization with various types of hats, and, in particular, for utilization with a cap having a head covering member and a bill or brim coupled to the head covering member and extending outwardly therefrom. Such caps are often worn by sportsmen, baseball players and the like. In general, however, such caps generally have a very flexible head covering portion and the bill or brim is somewhat more rigid than the head covering portion, but is not structurally able to support comparatively heavy weights. Further, when such a cap is worn by sportsmen, baseball players, or the like, it is often desired that some form of face, or at least eye shield, be provided in order to protect the eyes of the wearer from the glare of the sun, from rain, wind, or snow blowing in the face, or from dust or other foreign particles blowing in the face or eyes of the wearer. In such applications, moreover, the face shielding provisions thereof may not be required at all times while the cap is being worn. Thus, it is preferred that the face shield be movable from the face shielding position to a clear position where the face shield is not interposed in front of the face of the wearer. Such movement should be able to be rapidly accomplished with a minimum of complexity. Thus, the face shield may be quickly and rapidly moved between these two positions as desired by the wearer. Additionally, the face shield may not be needed for extended periods of time, while the cap is being worn, and, during these extended periods of time, it is preferred that the entire visor arrangement, having the face shield, be carried on the cap in a stored position wherein it does not interfere with the normal wearing of the cap and the user's activities, but is readily available for utilization as a face shield when desired.

SUMMARY OF THE INVENTION

Accordingly, it is an object of the present invention to provide an improved detachable visor for a cap.

It is another object of the present invention to provide an improved detachable visor for a cap that is movable between a plurality of positions on the cap.

It is another object of the present invention to provide a detachable visor arrangment for a cap that is comparatively lightweight so that the bill or brim of a conventional cap has sufficient structural integrity to support the visor arrangement.

It is yet another object of the present invention to provide an improved detachable visor for a cap that is comparatively inexpensive to fabricate, provides a face shielding or guarding characteristic for the wearer of the cap and may be readily adapted to different sizes of caps.

The above and other objects are achieved, according to a preferred embodiment of the present invention, by providing a detachable visor arrangement for a cap wherein the cap is of the type having a head covering member and a bill member coupled to the head covering member and extending outwardly therefrom. The bill or brim member has an upper surface and a lower surface and a peripheral edge.

The visor arrangement has an arcuate rim means having a first end and a second end. The first end and second end are spaced a preselected distance apart and are in opposed relationship to each other. The arcuate rim also has the face shield holding member extending between the first end and the second end. An arcuate face shield is coupled to the arcuate face shield holding member of the arcuate rim means and extends a predetermined distance therefrom. This predetermined distance may be selected to provide a face shield that guards and protects only regions adjacent the eyes of the wearer, or it can extend further and protect the entire face. The face shield may be transparent or translucent and may be clear or tinted as may be required for particular applications. A first and second hinge means are coupled to the first and second ends, respectively, on the arcuate rim means, and first and second clip means are coupled, respectively, to the first and second hinge means. The clip means provide for a detachable mounting on the bill of the cap. The location where the clip means detachably mount on the bill of the cap is generally near the peripheral edge in regions adjacent the head covering member, but on opposite sides of the bill of the cap. Thus, the first clip means is detachably mountable at a first such location on the bill of the cap and the second clip means is detachably mountable at a second such location on the bill of the cap.

The entire visor arrangement has a first mounting condition on the cap and a second mounting condition on the cap. In the first mounting condition, the face shield has a first position where it depends downwardly from the underside of the bill of the cap, and is therefore in front of the face of the wearer and thus comprises a face guarding position. While still in a first mounting condition, the face shield is pivotally movable on the hinge means from the face guarding position to the clear position. In the clear position, the face shield extends upwardly from the upper surface of the bill of the cap. The hinge means allows quick and rapid movement between the clear position and the face guarding position as may be desired by the wearer of the cap.

When the wearer of the cap does not anticipate the need for the face guarding position, the visor arrangement of the present invention may be conveniently moved to the second mounting condition on the cap. In the second mounting condition, the visor is turned end for end, so that the first clip means detachably mounts at the second location on the bill of the cap and the second clip means detachably mounts at the first location on the bill of the cap. Thus, the visor arrangement is detachably mounted substantially upside down on the bill of the cap, with the face shield extending upwardly from the upper surface of the cap.

BRIEF DESCRIPTION OF THE DRAWING

The above and other embodiments of the present invention may be more fully understood from the following detailed description taken together with the accompanying drawing, wherein similar reference characters refer to similar elements throughout and in which.

DESCRIPTION OF THE PREFERRED EMBODIMENTS

Figure 1:
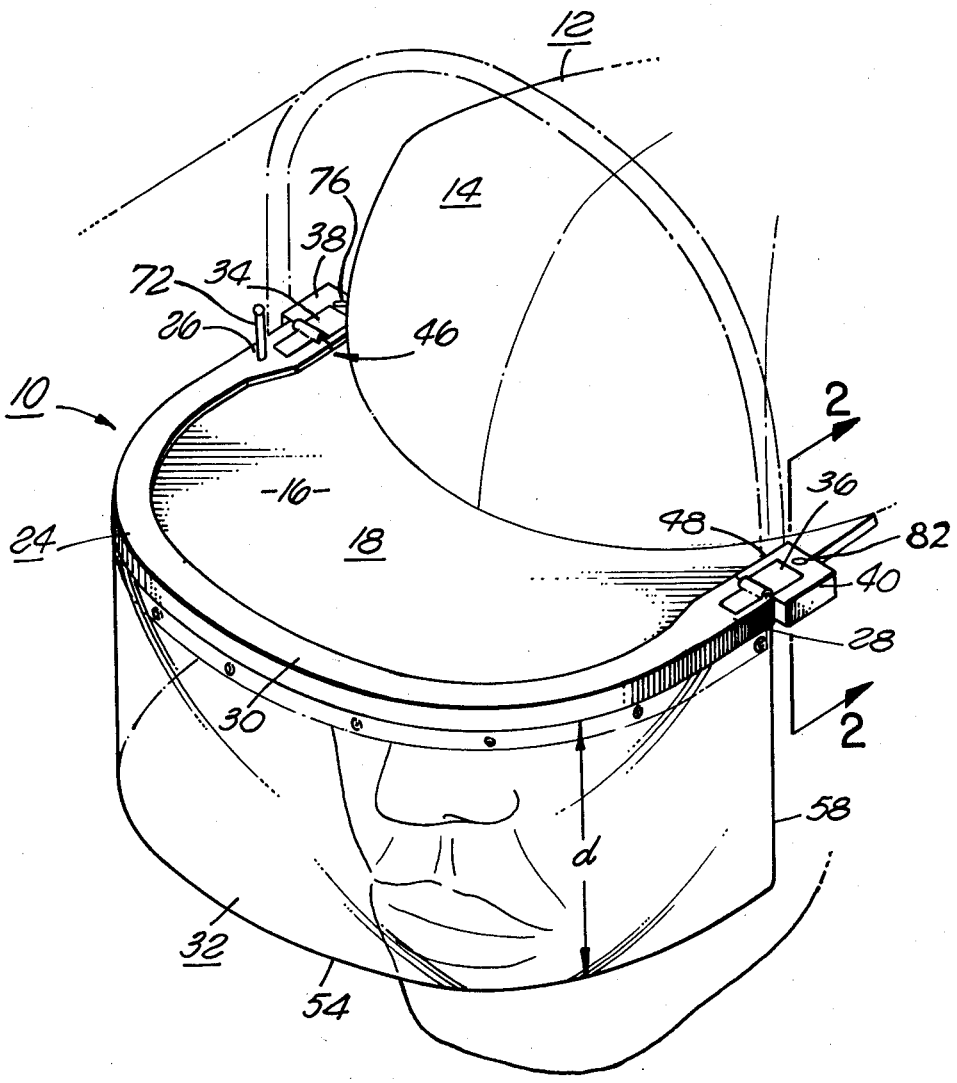
FIG. 1 is a perspective view of a preferred embodiment of the present invention.

Referring now to the drawing, there is illustrated a preferred embodiment of a detachable visor arrangement according to the principles of the present invention, generally designated 10. In FIG. 1, the detachable visor arrangement of 10 is shown mounted on a cap 12, of the type having a head covering member 14 and the bill member 16. Such caps are often termed baseball caps, billed caps, or the like and the head covering member 14 is generally a flexible cloth and the bill member 16 generally is more rigid than the flexible head covering member 14, but still is flexible and is not intended as a strong structural support member. The bill member 16 has an upper surface 18, a lower surface 20, and peripheral edges 22.

According to the principles of the present invention, the detachable visor arrangement 10 is detachably mountable on the cap 12. The detachable visor arrangement 10 has an arcuate rim means 24, having a first end 26 and a second end 28 which is spaced a preselected distance from the first end 26 and in opposed relationship thereto. The preselected distance is selected to fall within the range of the widths of the bill member 16 of caps 12. The arcuate rim means 24 also is provided with a face shield holding member 30 which extends between the first end 26 and second end 28.

An arcuate face shield 32 is coupled to the arcuate face shield holding member 30 of the rim means 24 and extends a predetermined distance indicated on FIG. 1 by the letter "d" which may be selected to prrovide coverage and protection for, when in the position shown in FIG. 1, only the eyes of the wearer or may extend down a greater distance to provide protection for the full face of the wearer.

A first hinge means 34 is coupled to the first end 26 of arcuate rim means 24 and a second hinge means 36 is coupled to the second end 28 of arcuate rim means 24.

Figure 2:
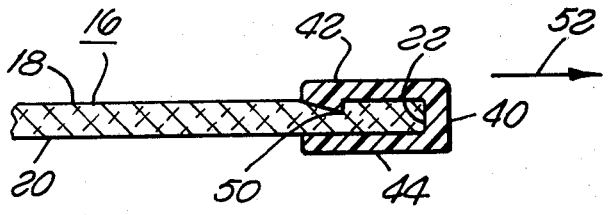
FIG. 2 is a sectional view along the line 2—2 of FIG. 1.

A first clip means 38, is coupled to the first hinge means 34 and a second clip means 40 is coupled to the second hinge means 36. Each of the clip means, 38 and 40, have upper surfaces as shown in FIG. 2 for hinge means 40 and indicated at 42 and a lower surface as shown on FIG. 2 for hinge means 40 as indicated at 44. Clip means 38 is constructed substantially identically to clip means 40. The clip means 38 and 40 detachably mount the visor arrangement 10 on the bill 16 of the cap 12. The first clip means 38 is detachably mountable on the bill means 16 in a region adjacent the peripheral edge 22 and head covering member 14 as indicated at 46 and the second clip means 40 is detachably mountable on the bill member 16 of the cap 12 at a second location indicated at 48 in regions adjacent the head covering member 14, but oppositely disposed from the first location 46. Many variations of the exact form of providing a detachable coupling may be utilized. As shown in FIG. 2, the preferred embodiment 10 of the present invention, the clip means 38 and 40 are provided with at least one internal tooth member 50 which engages the bill member 16 to provide the detachable mounting. The clip means 38 and 40 are resiliently deformable so that the tooth member 50 may be selectively disengaged from the bill member 16. Thus, the tooth member 40 resists forces in the direction indicated by the arrow 52, which would tend to demount the detachable visor arrangement 10 from the bill 16.

The face shield 32 has a lower rim 54, a first side edge 56 (shown on FIG. 3) and a second side edge 58. The first side edge 56 is generally aligned with the first end 26 of the rim means 24 and the second side edge 58 of the face shield 32 is generally aligned with the second end 28 of the rim means 24.

Figure 3:
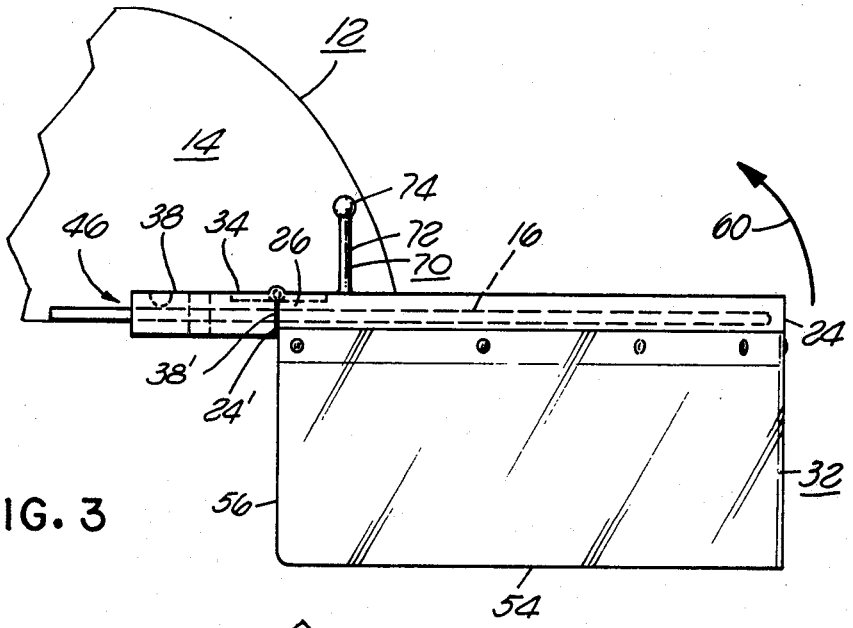
FIG. 3 illustrates a preferred embodiment of the present invention in the face guarding position of a first mounting condition.

According to the principles of the present invention, the detachable visor arrangement 10 is mountable in a plurality of positions on the cap 12. FIGS. 1 and 3 show the detachable visor arrangement 10 in a first mounting condition on the cap 12 and, more particularly, in a face guarding position of the first mounting condition. In the face guarding position, the face shield 32 depends downwardly from the arcuate rim means 24 and is in front of the face of the wearer of the cap 12 to provide the desired protection from sun, wind, dust, foreign particles, or the like. First restraining means are provided to restrain the detachable visor arrangement 10 in the face guarding position of the first mounting condition. The first restraining means for so restraining the detachable visor arrangement 10 comprises the abutment of the end surface 38' of the clip means 38, with the end surface 24' at the second end 26 of the arcuate rim means 24. The weight of the arcuate face shield means 32 and arcuate rim means 24 is sufficient to maintain the position illustrated in FIGS. 1 and 3. For example, the face shield 32 may be fabricated from an acrylic plastic, or similar materials in either a clear transparent condition or a translucent condition, and/or a tinted condition, depending upon the particular application. In general, the face shield 32 may be approximately $\frac{1}{8}$th of an inch thick and have the distance "d" on the order of 2 to 8 inches.

Figure 4:
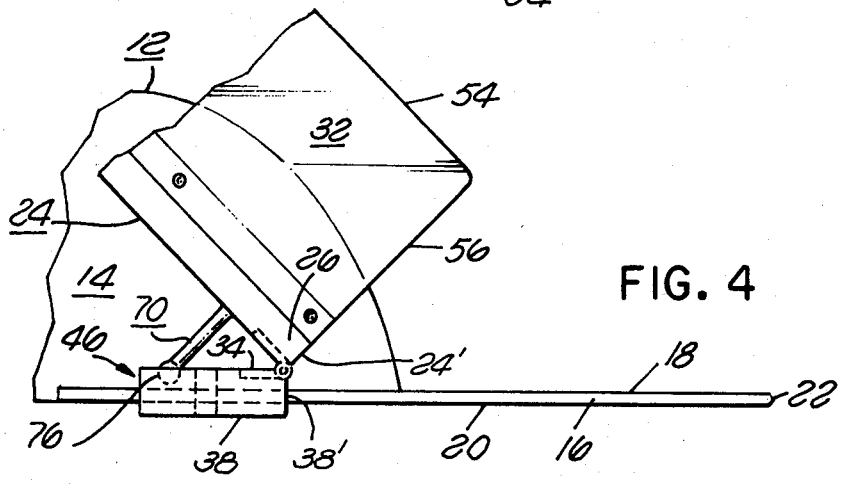
FIG. 4 illustrates a preferred embodiment of the present invention in a clear position of the first mounting condition.

While still in the first mounting condition shown in FIGS. 1 and 3, according to the principles of the present invention, the face shield 32 may be pivoted upwardly in the direction indicated by the arrow 60 on FIG. 3, to a clear position, as shown on FIG. 4. As shown on FIG. 4, the clear position is where the face shield 32 has been rotated approximately 90° in the direction indicated by the arrow 60, and the face shield 32 extends upwardly from the upper surface 18 of the bill member 16 of the cap 12. Second restraining means generally designated 70, may be provided to restrain the face shield 32 in the clear position as illustrated in FIG. 4. The second restraining means 70 generally comprises a protuberance 72 coupled to the rim 24 in regions adjacent the second end 26. The protuberance 72 is generally flexible and has a headed end 74. The headed end 74 fits into a first protuberance receiving cavity 76 in the clip means 38 for frictional retention therein. It will be appreciated, of course, that the similar restraining means 70 may be provided at the second end 28 of the rim means 24, with a corresponding cavity in the clip means 40. Thus, the face shield 32 is quickly and easily moved from the face guarding position shown in FIG. 3 to the clear position shown in FIG. 4 and restrained therein as desired by the wearer of the cap 12. Therefore, as noted above, in the clear position shown in FIG. 4, the rim means 24 and the face shield 32 extend upwardly from the upper surface 18 of the bill 16.

Figure 5:
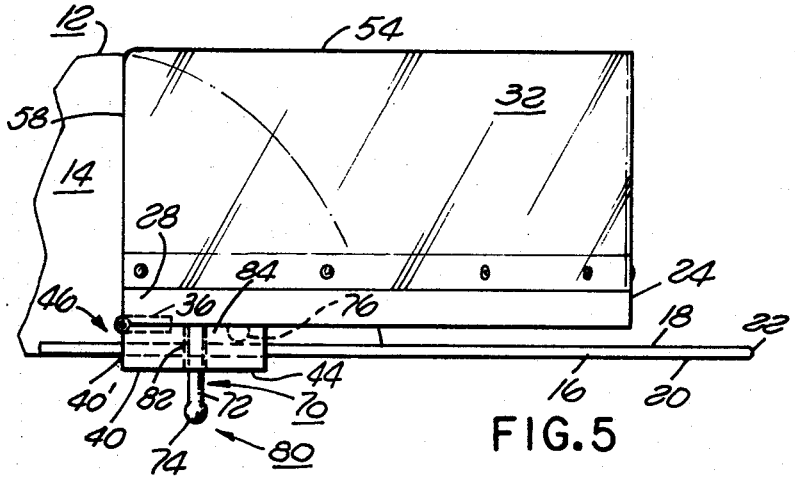
FIG. 5 illustrates a preferred embodiment of the present invention in the second mounting condition.

In accordance with the principles of the present invention, the embodiment 10 may also be mounted in a second mounting condition on the cap 12 as illustrated in FIG. 5. The second mounting condition, as illustrated in FIG. 5 is intended to be utilized when the face guarding characteristics are not desired to be utilized for comparatively long periods of time.

FIG. 5 illustrates the preferred embodiment 10 of the detachable visor arrangement according to the principles of the present invention in a second mounting condition on the cap 12. The second mounting condition, as shown in FIG. 5, is intended to be utilized when there are extended periods of time that the wearer of the cap 12 does not desire to utilize the face guarding features of the present invention and thus provides a convenient storage and carrying position for the detachable visor arrangement 10 on the cap 12. As shown on FIG. 5, to place the detachable visor arrangement 10 in the second mounting position, the visor arrangement 10 is turned end for end so that the second clip means 40 mounts on the bill member 16 at the location 46 and, similarly, the first clip means 38 mounts at the second location 48 on the bill member 16. Thus, the end surface 40' of second clip means 40, which corresponds to the end surface 38' of first clip means 38, is positioned adjacent the head covering member 14 of the cap 12 as opposed to the spaced relationship therebetween as illustrated for the end surface 38' of first clip means 38 in FIGS. 1, 3 and 4. The third restraining means, generally designated 80, is utilized to restrain the face shield 32 in the second mounting condition as illustrated on FIG. 5 and, in general, the third restraining means 80 generally comprises structure the same as the second restraining means 70, described above, except that the protuberance 72 extends through a cavity 82 defined by second walls 84 in the second clip means 40, with the head 74 of the protuberance 72 extending to regions adjacent the lower surface 44, thus restraining the detachable arrangement 10, in the position shown in FIG. 5.

Preferably, both the rim means 24 and face shield 32 have a predetermined degree of flexibility so that the spatial distance between the first clip means 38 and second clip means 40 may be varied, depending upon the width of the bill member 16.

From the above, it can be seen that there has been provided an improved detachably mountable visor arrangement, particularly adapted for utilization on caps of the type having a bill or brim portion. Those skilled in the art may find many variations and adaptations of the present invention, and all such variations and adaptations falling within the scope and spirit of the appended claims are intended to be covered thereby.

What is claimed is:

1. A detachable visor arrangement for a cap, said cap of the type having a head covering member and a bill member coupled thereto and extending outwardly therefrom, and said bill member having an upper surface, a lower surface, and peripheral edges, and comprising, in combination:

an arcuate rim means having a first end, a second end spaced a preselected distance from said first end, and in opposed relationship thereto, and a face shield holding member extending between said first end and said second end;

an arcuate face shield coupled to said arcuate face shield holding member of said arcuate rim means and extending a predetermined distance therefrom;

a first and a second hinge means coupled to said first and said second end, respectively, of said arcuate rim means;

a first clip means and a second clip means coupled to said first and said second hinge means, respectively, for detachable mounting on said peripheral edge of said bill member of said cap, and said first clip means mountable at a first location on said peripheral edge of said bill member of said cap and said second clip means mountable at a second location on said peripheral edge of said bill member of said cap for a first mounting condition of said face shield on said cap, and said first clip means mountable at said second location on said peripheral edge of said bill member of said cap and said second clip means mountable at said first location on said peripheral edge of said bill member of said cap for a second mounting condition of said face shield on said cap;

and said face shield extending downwardly from said lower surface of said bill member to regions below said bill member and said arcuate rim means adjacent said peripheral edge of said bill member for said face shield in a face guarding position of said first mounting condition, and said face shield pivotally movable on said hinge means in said first mounting condition from said face guarding position to a clear position wherein said rim means extends upwardly from said upper surface of said bill member of said cap;

said arcuate rim means adjacent said peripheral edge of said bill member of said cap on the upper surface thereof and said face shield extending upwardly from said upper surface of said bill member of said cap for said face shield in said second mounting condition;

first restraining means for restraining said face shield in said face guarding position thereof;

second restraining means for restraining said face shield in said clear position thereof; and third restraining means for restraining said face shield in said second mounting condition.

2. The arrangement defined in claim 1, wherein:

said rim means and said arcuate face shield have a predetermined resiliency, whereby said preselected distance between said first end and said second end of said rim means may be varied to accommodate sized bill members.

3. The arrangement defined in claim 2, wherein:

each of said first and second clip means have upper surfaces and lower surfaces, and said upper surfaces of each of said first and second hinge means are in regions adjacent said upper surface of said bill member of said cap and said lower surfaces of each of said first and second clip means are in regions adjacent said lower surface of said bill member of said cap for the condition of said face shield being in said first and said second mounting conditions thereof, and said first end of said rim means overlies and abuts against said upper surface of said first clip means and said second end of said rim means overlies and abuts against said upper surface of said second clip means for said face shield in said second mounting condition thereof.

4. The arrangement defined in claim 1, wherein:

said second restraining means further comprises:

protuberance means on said first end of said rim means;

first walls defining a first protuberance receiving cavity on said first clip means for frictionally retaining said protuberance to restrain said face shield in said clear position thereof.

5. The arrangement defined in claim 4, wherein:

said third restraining means further comprises:

second walls defining a second protuberance receiving cavity on said second clip means for frictionally restraining said protuberance to restrain said face shield in said second mounting condition thereof.

6. The arrangement defined in claim 5, wherein:

said rim means and said arcuate face shield have a predetermined resiliency, whereby said preselected distance between said first end and said second end of said rim means may be varied to accommodate sized bill members.

7. The arrangement defined in claim 5, wherein:

each of said first and second clip means have upper surfaces and lower surfaces, and said upper surfaces of each of said first and second hinge means are in regions adjacent said upper surface of said bill member of said cap and said lower surfaces of each of said first and second clip means are in regions adjacent said lower surface of said bill member of said cap for the condition of said face shield being in said first and said second mounting conditions thereof, and said first end of said rim means overlies and abuts against said upper surface of said first clip means and said second end of said rim means overlies and abuts against said upper surface of said second clip means for said face shield in said second mounting condition thereof.

8. The arrangement defined in claim 7, wherein:

said rim means and said arcuate face shield have a predetermined resiliency, whereby said preselected distance between said first end and said second end of said rim means may be varied to accommodate sized bill members.

9. The arrangement defined in claim 4, wherein:

said rim means and said arcuate face shield have a predetermined resiliency, whereby said preselected distance between said first end and said second end of said rim means may be varied to accommodate sized bill members.

10. The arrangement defined in claim 4, wherein:

each of said first and second clip means have upper surfaces and lower surfaces, and said upper surfaces of each of said first and second hinge means are in regions adjacent said upper surface of said bill member of said cap and said lower surfaces of each of said first and second clip means are in regions adjacent said lower surface of said bill member of said cap for the condition of said face shield being in said first and said second mounting conditions thereof, and said first end of said rim means overlies and abuts against said upper surface of said first clip means and said second end of said rim means overlies and abuts against said upper surface of said second clip means for said face shield in said second mounting condition thereof.

11. The arrangement defined in claim 10, wherein:

said rim means and said arcuate face shield have a predetermined resiliency, whereby said preselected distance between said first end and said second end of said rim means may be varied to accommodate sized bill members.

12. The arrangement defined in claim 1, wherein:

each of said first and second clip means have upper surfaces and lower surfaces, and said upper surfaces of each of said first and second hinge means are in regions adjacent said upper surface of said bill member of said cap and said lower surfaces of each of said first and second clip means are in regions adjacent said lower surface of said bill member of said cap for the condition of said face shield being in said first and said second mounting conditions thereof, and said first end of said rim means overlies and abuts against said upper surface of said first clip means and said second end of said rim means overlies and abuts against said upper surface of said second clip means for said face shield in said second mounting condition thereof.

* * * * *